US009485833B2

(12) United States Patent
Datta et al.

(10) Patent No.: US 9,485,833 B2
(45) Date of Patent: Nov. 1, 2016

(54) METHOD AND APPARATUS FOR INCREASING DIMMING RANGE OF SOLID STATE LIGHTING FIXTURES

(75) Inventors: Michael Datta, Brookline, MA (US); Gregory Campbell, Walpole, MA (US)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 981 days.

(21) Appl. No.: 13/636,165

(22) PCT Filed: Mar. 11, 2011

(86) PCT No.: PCT/IB2011/051041

§ 371 (c)(1),
(2), (4) Date: Nov. 29, 2012

(87) PCT Pub. No.: WO2011/117770

PCT Pub. Date: Sep. 29, 2011

(65) Prior Publication Data

US 2013/0141001 A1 Jun. 6, 2013

Related U.S. Application Data

(60) Provisional application No. 61/317,423, filed on Mar. 25, 2010.

(51) Int. Cl.
*H05B 37/02* (2006.01)
*H05B 33/08* (2006.01)

(52) U.S. Cl.
CPC ..... *H05B 37/02* (2013.01); *H05B 33/0809* (2013.01); *H05B 33/0845* (2013.01)

(58) Field of Classification Search
USPC ..... 315/224
See application file for complete search history.

(56) References Cited

U.S. PATENT DOCUMENTS

| | | | | |
|---|---|---|---|---|
| 6,016,038 | A | 1/2000 | Mueller et al. | |
| 6,211,626 | B1 | 4/2001 | Lys et al. | |
| 7,256,554 | B2 | 8/2007 | Lys | |
| 7,288,902 | B1 * | 10/2007 | Melanson | H03K 17/18 315/224 |
| 8,922,129 | B1 * | 12/2014 | Rodriguez | H05B 33/0848 315/200 R |
| 2008/0224633 | A1 | 9/2008 | Melanson et al. | |
| 2009/0160369 | A1 * | 6/2009 | Godbole | H05B 33/0815 315/307 |
| 2009/0261744 | A1 * | 10/2009 | Chen | H05B 41/3925 315/199 |
| 2011/0037399 | A1 * | 2/2011 | Hung | H05B 33/0815 315/219 |

FOREIGN PATENT DOCUMENTS

| | | | |
|---|---|---|---|
| JP | 2009026544A | A | 2/2009 |
| WO | 2009054290 | A1 | 4/2009 |
| WO | 2009094329 | A1 | 7/2009 |

* cited by examiner

*Primary Examiner* — Douglas W Owens
*Assistant Examiner* — James H Cho

(57) ABSTRACT

A system for controlling a level of light output by a solid state lighting load controlled by a dimmer includes a phase angle detector and a power converter. The phase angle detector is configured to detect a phase angle of the dimmer based on a rectified voltage from the dimmer and to determine a power control signal based on comparison of the detected phase angle with a predetermined first threshold. The power converter is configured to provide an output voltage to the solid state lighting load, the power converter operating in an open loop mode based on the rectified voltage from the dimmer when the detected phase angle is greater than the first threshold, and operating in a closed loop mode based on the rectified voltage from the dimmer and the determined power control signal from the detection circuit when the detected phase angle is less than the first threshold.

20 Claims, 6 Drawing Sheets

METHOD AND APPARATUS FOR INCREASING DIMMING RANGE OF SOLID STATE LIGHTING FIXTURES

TECHNICAL FIELD

The present invention is directed generally to control of solid state lighting fixtures. More particularly, various inventive methods and apparatuses disclosed herein relate to selectively increasing dimming ranges of solid state lighting fixtures using power control signals determined based on dimmer phase angle detection.

BACKGROUND

Digital or solid state lighting technologies, i.e. illumination based on semiconductor light sources, such as light-emitting diodes (LEDs), offer a viable alternative to traditional fluorescent, HID, and incandescent lamps. Functional advantages and benefits of LEDs include high energy conversion and optical efficiency, durability, lower operating costs, and many others. Recent advances in LED technology have provided efficient and robust full-spectrum lighting sources that enable a variety of lighting effects in many applications. Some of the fixtures embodying these sources feature a lighting module, including one or more LEDs capable of producing different colors, e.g. red, green, and blue, as well as a processor for independently controlling the output of the LEDs in order to generate a variety of colors and color-changing lighting effects, for example, as discussed in detail in U.S. Pat. Nos. 6,016,038 and 6,211,626, incorporated herein by reference. LED technology includes line voltage powered white lighting fixtures, such as the ESSENTIALWHITE series, available from Philips Color Kinetics. These fixtures may be dimmable using trailing edge dimmer technology, such as electric low voltage (ELV) type dimmers for 120VAC line voltages.

Many lighting applications make use of dimmers. Conventional dimmers work well with incandescent (bulb and halogen) lamps. However, problems occur with other types of electronic lamps, including compact fluorescent lamp (CR), low voltage halogen lamps using electronic transformers and solid state lighting (SSL) lamps, such as LEDs and OLEDs. Low voltage halogen lamps using electronic transformers, in particular, may be dimmed using special dimmers, such as ELV type dimmers or resistive-capacitive (RC) dimmers, which work adequately with loads that have a power factor correction (PFC) circuit at the input.

Conventional dimmers typically chop a portion of each waveform of the mains voltage signal and pass the remainder of the waveform to the lighting fixture. A leading edge or forward-phase dimmer chops the leading edge of the voltage signal waveform. A trailing edge or reverse-phase dimmer chops the trailing edge of the voltage signal waveform. Electronic loads, such as LED drivers, typically operate better with trailing edge dimmers.

Incandescent and other conventional resistive lighting devices respond naturally without error to a chopped sine wave produced by a phase chopping dimmer. In contrast, LED and other solid state lighting loads may incur a number of problems when placed on such phase chopping dimmers, such as low end drop out, triac misfiring, minimum load issues, high end flicker, and large steps in light output. In addition, the minimum light output by a solid sate lighting load when the dimmer is at its lowest setting is relatively high. For example, the low dimmer setting light output of an LED can be 15-30 percent of the maximum setting light output, which is an undesirably high light output at the low setting. The high light output is further aggravated by the fact that the human eye response is very sensitive at low light levels, making the light output seem even higher. Thus, there is a need for reducing light output by a solid state lighting load when the corresponding dimmer is set to a low setting.

SUMMARY

The present disclosure is directed to inventive methods and devices for reducing light output by a solid state lighting load when a phase angle or dimming level of a dimmer is set at low settings. Generally, in one aspect, a system for controlling a level of light output by a solid state lighting load controlled by a dimmer includes a phase angle detector and a power converter. The phase angle detector is configured to detect a phase angle of the dimmer based on a rectified voltage from the dimmer and to determine a power control signal based on comparison of the detected phase angle with a predetermined first threshold. The power converter is configured to provide an output voltage to a solid state lighting load. The power converter operates in an open loop mode based on the rectified voltage from the dimmer when the detected phase angle is greater than the first threshold, and operates in a closed loop mode based on the rectified voltage from the dimmer and the determined power control signal from the phase angle detector when the detected phase angle is less than the first threshold.

In another aspect, a power throttling method controls a level of light output by a solid state lighting load through a power controller connected to a dimmer. The method includes detecting a phase angle of the dimmer corresponding to a dimming level set at the dimmer; when the detected phase angle is greater than a first dimming threshold, generating a power control signal having a first fixed power setting and modulating a light output level of the solid state lighting load based on a magnitude of voltage output by the dimmer; and when the detected phase angle is less than the first dimming threshold, generating the power control signal having a power setting determined as a function of the detected phase angle, and modulating the light output level of the solid state lighting load based on the magnitude of voltage output by the dimmer and the determined power setting.

In another aspect, a device includes an LED load, a phase angle detection circuit and a power converter. The LED load has a light output responsive to a phase angle of a dimmer. The phase angle detection circuit is configured to detect the dimmer phase angle and to output a PWM power control signal from a PWM output, the PWM power control signal having a duty cycle determined based on the detected dimmer phase angle. The power converter is configured to receive a rectified voltage from the dimmer and the PWM power control signal from the phase angle detection circuit, and to provide an output voltage to the LED load. The phase angle detection circuit sets the duty cycle of the PWM power control signal to a fixed high percentage when the detected phase angle exceeds a high threshold, causing the power converter to determine the output voltage based on a magnitude of the rectified voltage. The phase angle detection circuit sets the duty cycle of the PWM power control signal to a variable percentage, calculated as a predetermined function of the detected phase angle, when the detected phase angle is less than the high threshold, causing the power converter to determine the output voltage based on the PWM power control signal in addition to the magnitude of the rectified voltage.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum, and a variety of dominant wavelengths within a given general color categorization.

For example, one implementation of an LED configured to generate essentially white light (e.g., LED white lighting fixture) may include a number of dies which respectively emit different spectra of electroluminescence that, in combination, mix to form essentially white light. In another implementation, an LED white lighting fixture may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white light LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, pyroluminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers.

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "lighting fixture" is used herein to refer to an implementation or arrangement of one or more lighting units in a particular form factor, assembly, or package. The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources. A "multi-channel" lighting unit refers to an LED-based or non LED-based lighting unit that includes at least two light sources configured to respectively generate different spectrums of radiation, wherein each different source spectrum may be referred to as a "channel" of the multi-channel lighting unit.

The term "controller" is used herein generally to describe various apparatus relating to the operation of one or more light sources. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, microcontrollers, application specific integrated circuits (ASICs), and field-programmable gate arrays (FPGAs).

In various implementations, a processor and/or controller may be associated with one or more storage media (generically referred to herein as "memory," e.g., volatile and non-volatile computer memory such as random-access memory (RAM), read-only memory (ROM), programmable read-only memory (PROM), electrically programmable read-only memory (EPROM), electrically erasable and programmable read only memory (EEPROM), universal serial bus (USB) drive, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present invention discussed herein. The terms "program" or "computer program" are used herein in a generic sense to refer to any type of computer code (e.g., software or microcode) that can be employed to program one or more processors or controllers.

In one network implementation, one or more devices coupled to a network may serve as a controller for one or more other devices coupled to the network (e.g., in a master/slave relationship). In another implementation, a networked environment may include one or more dedicated controllers that are configured to control one or more of the devices coupled to the network. Generally, multiple devices coupled to the network each may have access to data that is present on the communications medium or media; however, a given device may be "addressable" in that it is configured to selectively exchange data with (i.e., receive data from and/or transmit data to) the network, based, for example, on one or more particular identifiers (e.g., "addresses") assigned to it.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same or similar parts throughout the different views. Also, the drawings are not necessarily to scale, emphasis instead generally being placed upon illustrating the principles of the invention.

DETAILED DESCRIPTION

In the following detailed description, for purposes of explanation and not limitation, representative embodiments disclosing specific details are set forth in order to provide a thorough understanding of the present teachings. However, it will be apparent to one having ordinary skill in the art having had the benefit of the present disclosure that other embodiments according to the present teachings that depart from the specific details disclosed herein remain within the scope of the appended claims. Moreover, descriptions of well-known apparatuses and methods may be omitted so as to not obscure the description of the representative embodiments. Such methods and apparatuses are clearly within the scope of the present teachings.

Applicants have recognized and appreciated that it would be beneficial to provide an apparatus and method for lowering the minimum output light level that can be otherwise achieved by an electronic transformer with a solid state lighting load connected to a phase chopping dimmer.

Figure 1:
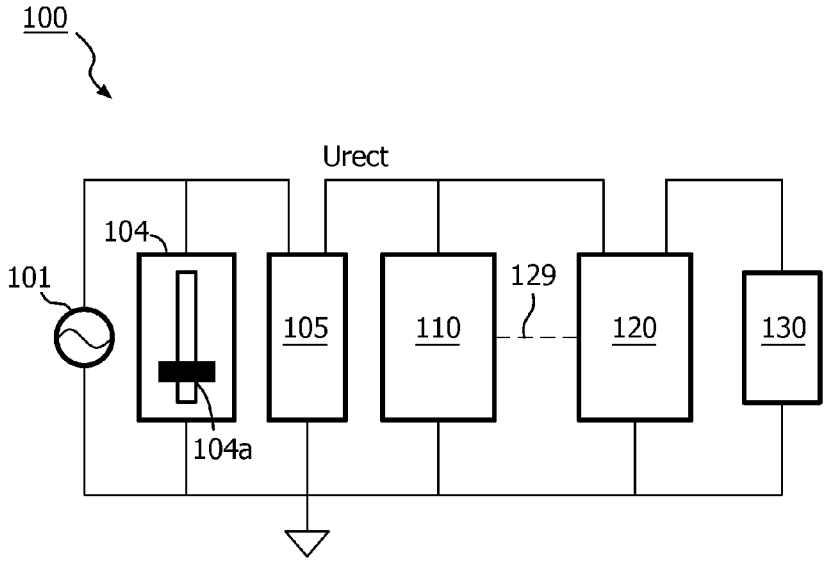
FIG. 1 is a block diagram showing a dimmable lighting system, including a solid state lighting fixture and a phase detector, according to a representative embodiment.

FIG. 1 is a block diagram showing a dimmable lighting system, including a solid state lighting fixture and a phase angle detector, according to a representative embodiment. Referring to FIG. 1, dimmable lighting system 100 includes dimmer 104 and rectification circuit 105, which provide a (dimmed) rectified voltage Urect from voltage mains 101. The voltage mains 101 may provide different unrectified input AC line voltages, such as 100VAC, 120VAC, 230VAC and 277VAC, according to various implementations. The dimmer 104 is a phase chopping dimmer, for example, which provides dimming capability by chopping leading edges (leading edge dimmer) or trailing edges (trailing edge dimmer) of voltage signal waveforms from the voltage mains 101 in response to vertical operation of its slider 104*a*. Generally, the magnitude of the rectified voltage Urect is proportional to the dimming level set by the dimmer 104, such that a lower phase angle or dimming level results in a lower rectified voltage Urect. In the depicted example, it may be assumed that the slider is moved downward to lower the phase angle, reducing the amount of light output by solid state lighting load 130, and is moved upward to increase the phase angle, increasing the amount of light output by the solid state lighting load 130.

The dimmable lighting system 100 further includes phase angle detector 110 and power converter 120. Generally, the phase angle detector 110 detects the phase angle of the dimmer 104 based on the rectified voltage Urect, and outputs a power control signal via control line 129 to the power converter 120. The power control signal may be a pulse code modulation (PCM) signal or other digital signal, for example, and may alternate between high and low levels in accordance with a duty cycle determined by the phase angle detector 110 based on the detected phase angle. The duty cycle may range from about 100 percent (e.g., continually at the high level) to about zero percent (e.g., continually at the low level), and includes any percentage in between in order to adjust appropriately the power setting of the power converter 120 to control the level of light emitted by the solid state lighting load 130, as discussed below. A percentage duty cycle of 70 percent, for example, indicates that a square wave of the power control signal is at the high level for 70 percent of a wave period and at the low level for 30 percent of the wave period.

In various embodiments, the power converter 120 receives the rectified voltage Urect from the rectification circuit 105, and outputs a corresponding DC voltage for powering the solid state lighting load 130. The power converter 120 converts between the rectified voltage Urect and the DC voltage based on at least one of two variables: (1) the magnitude of the voltage output from the dimmer 104 via the rectification circuit 105, e.g., set by operation of the slider 104*a*, and (2) the power setting value of a power control signal generated and output by the phase angle detector 110 via control line 129, e.g., set in accordance with a predetermined control function or algorithm, discussed below. The DC voltage output by the power converter 120 thus reflects the dimmer phase angle (i.e., the level of dimming) applied by the dimmer 104, even at low dimming levels below which a conventional dimming lighting system would no longer provide further reduction in light output by the solid state lighting load 130. The function for converting between the rectified voltage Urect and the DC voltage may also depend on additional factors, such as properties of the power converter 120, the type and configuration of solid state lighting load 130, and other application and design requirements of various implementations, as would be apparent to one of ordinary skill in the art.

In various embodiments, the dimmable lighting system 100 provides selective closed loop power throttling of the solid state lighting load 130. In other words, the power converter 120 selectively operates in closed loop mode or open loop mode, depending on the dimmer phase angle detected by the phase detector 110. In open loop mode, the phase angle detector 110 sets the power control signal to a constant or fixed power setting, which fixes the operating point of the power converter 120. The power converter 120 therefore converts between the rectified voltage Urect and the DC voltage based only on the magnitude of the received voltage Urect, delivering a specified amount of power from the voltage mains 101 to the solid state lighting load 130. In closed loop mode, the phase angle detector 110 calculates a variable power setting of the power control signal, which dynamically adjusts the operating point of the power converter 120. The power converter 120 therefore converts between the rectified voltage Urect and the DC voltage based on the power setting of the power control signal, as well as the magnitude of the received voltage Urect.

The dimmable lighting system 100 may be configured to provide a closed loop range between high and low open loop ranges of the power converter 120. As discussed in detail below with reference to FIG. 3, the phase angle detector 110 may set the power control signal to a high fixed power setting when the detected phase angle is above a predetermined first threshold, and a low fixed power setting when the detected phase angle is below a predetermined second threshold, and to a calculated variable power setting when the detected phase angle is between the first threshold and second thresholds. For example, when the phase angle detector 110 detects a phase angle above the first threshold (e.g., a first low dimming level), it sets the power control signal to a high duty cycle (e.g., 100 percent) and the power converter 120 bases its output power only on variations in the magnitude of the rectified voltage Urect. Similarly, when the phase angle detector 110 detects a phase angle below the second threshold (e.g., a second low dimming level or zero light output), it sets the power control signal to a low duty cycle (e.g., zero percent), and the power converter 120 again bases its output power only on variations in the magnitude of the rectified voltage Urect. When the dimmer phase angle detector 110 detects a phase angle below the first threshold and above the second threshold, it dynamically calculates the duty cycle of the power control signal to reflect the detected phase angle, and the power converter 120 bases its output power based on the calculated duty cycle and variations in the magnitude of the rectified voltage Urect. Accordingly, the light output by the solid state lighting load 130 continues to dim, even at low dimming levels, e.g., below the first threshold, which would otherwise have no effect on the light output by conventional systems.

Figure 2:
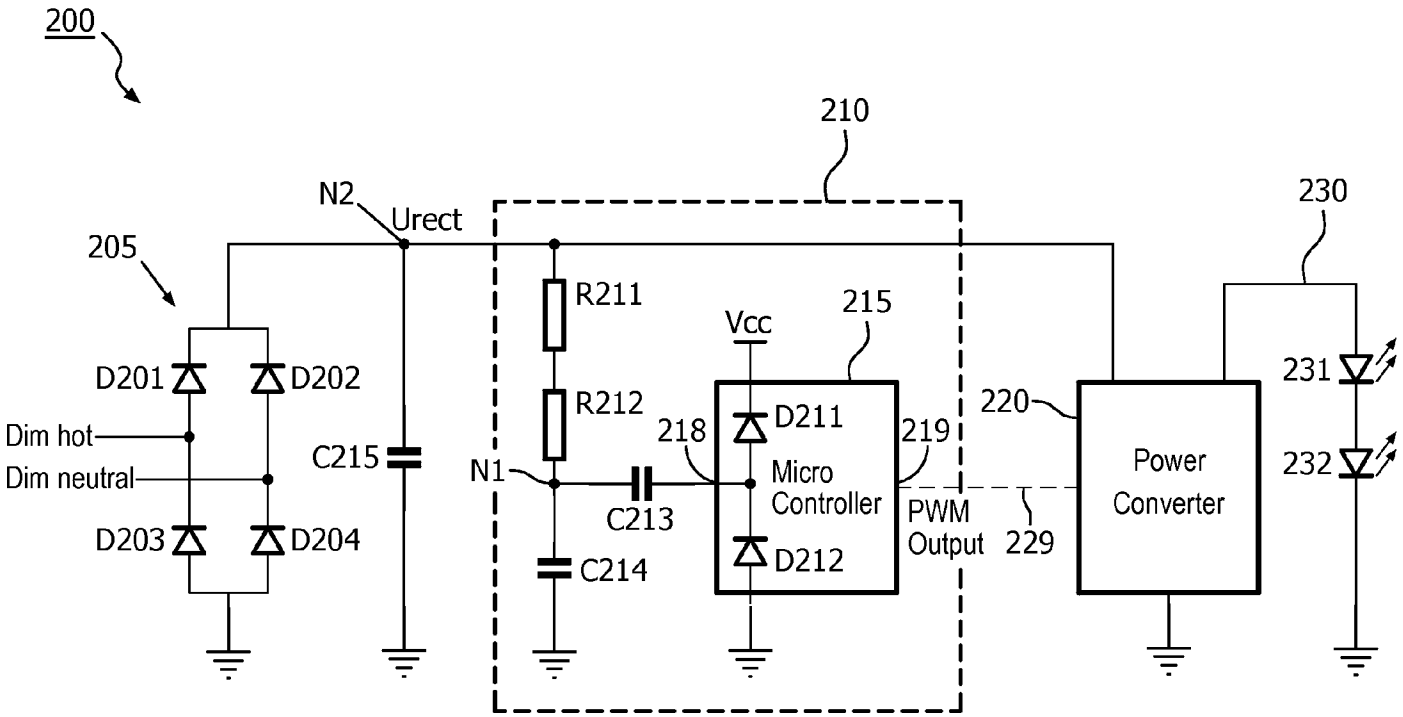
FIG. 2 is a circuit diagram showing a dimming control system, including a solid state lighting fixture and a phase detection circuit, according to a representative embodiment.

FIG. 2 is a circuit diagram showing a dimming control system, including a solid state lighting fixture and a dimmer phase angle detection circuit, according to a representative embodiment. The general components of FIG. 2 are similar to those of FIG. 1, although more detail is provided with respect to various representative components, in accordance with an illustrative configuration. Of course, other configurations may be implemented without departing from the scope of the present teachings.

Referring to FIG. 2, dimming control system 200 includes rectification circuit 205, dimmer phase angle detection circuit 210 (dashed box), power converter 220 and LED load 230. As discussed above with respect to the rectification circuit 105, the rectification circuit 205 is connected to a dimmer (not shown), indicated by the dim hot and dim neutral inputs to receive (dimmed) unrectified voltage from the voltage mains (not shown). In the depicted configuration, the rectification circuit 205 includes four diodes D201-D204 connected between rectified voltage node N2 and ground voltage. The rectified voltage node N2 receives the (dimmed) rectified voltage Urect, and is connected to ground through input filtering capacitor C215 connected in parallel with the rectification circuit 205.

The phase angle detector 210 detects the dimmer phase angle (level of dimming) based on the rectified voltage Urect and outputs a power control signal from PWM output 219 via control line 229 to the power converter 220 to control operation of the LED load 230. This allows the phase angle detector 210 to adjust selectively the amount of power delivered from the input mains to the LED load 230 based on the detected phase angle. In the depicted representative embodiment, the power control signal is a PWM signal having a duty cycle, determined by the phase angle detector 210, corresponding to a power setting to be provided to the power converter 220. Also, in the depicted representative embodiment, the phase angle detection circuit 210 includes microcontroller 215, which uses waveforms of the rectified voltage Urect to determine the dimmer phase angle and outputs the PWM power control signal through PWM output 219, discussed in detail below.

The power converter 220 receives the rectified voltage Urect at the rectified voltage node N2, and converts the rectified voltage Urect to a corresponding DC voltage for powering the LED load 230. The power converter 220 selectively operates in an open loop (or feed-forward) fashion, as described for example by Lys in U.S. Pat. No. 7,256,554, which is hereby incorporated by reference, and a closed loop fashion, depending on the PWM power control signal provided by the phase angle detection circuit 210. In various embodiments, the power converter 220 may be an L6562, available from ST Microelectronics, for example, although other types of power converters or other electronic transformers and/or processors may be included without departing from the scope of the present teachings. For example, the power converter 220 may be a fixed off-time, power factor corrected, single stage, inverting buck converter, although any type power converter with nominal open loop control may be utilized.

The LED load 230 includes a string of LEDs connected in series, indicated by representative LEDs 231 and 232, between an output of the power converter 220 and ground. The amount of load current through the LED load 230, and thus the amount of light emitted by the LED load 230, is controlled directly by the amount of power output by the power converter 220. The amount of power output by the power converter 220 is controlled by the magnitude of the rectified voltage Urect and the detected phase angle (level of dimming) of the dimmer, detected by the phase angle detection circuit 210.

Figure 3:
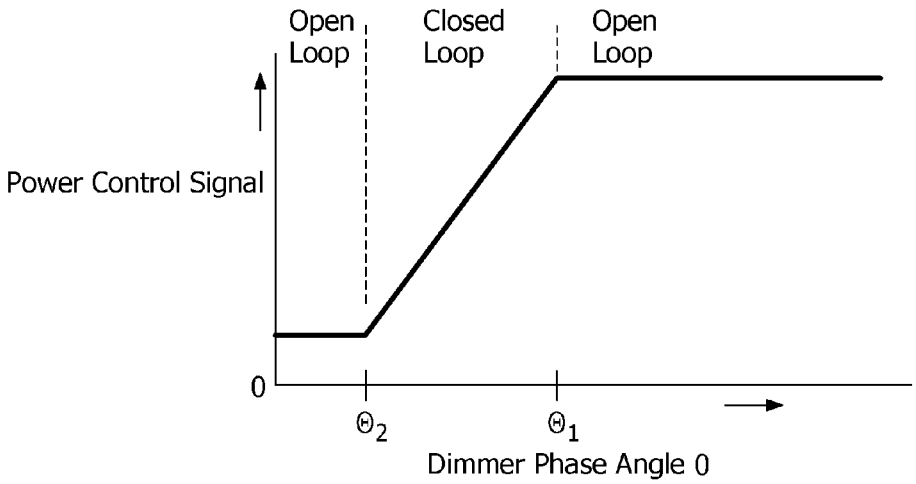
FIG. 3 is a graph showing power control signal values with respect to dimmer phase angle, according to a representative embodiment.

FIG. 3 is a graph showing power control signal values with respect to dimmer phase angle, according to a representative embodiment. Referring to FIG. 3, the vertical axis depicts the power setting of the power control signal increasing upward from a low or minimum power setting, and the horizontal axis depicts the dimmer phase angle (e.g., detected by the phase angle detection circuit 210), increasing right to left from a low or minimum dimming level.

When the phase angle detection circuit 210 determines that the dimmer phase angle is above a predetermined first threshold, indicated by first phase angle $\theta_1$, the duty cycle of the PWM power control signal is set to its highest power setting (e.g., 100 percent duty cycle), which fixes the operating point of the power converter 220. The power converter 220 therefore determines and outputs power to the LED load 230 based only on the magnitude of the rectified voltage Urect. In other words, the power converter 220 runs in an open loop, such that only the phase chopping dimmer modulates the power delivered to the output of the power converter 220, via the rectification circuit 205. In various embodiments, the first phase angle $\theta_1$ is the dimmer phase angle at which further reduction of the dimming level at the dimmer would not otherwise reduce the light output by the LED load 230, which may be about 15-30 percent of the maximum setting light output, for example.

When the phase angle detection circuit 210 determines that the dimmer phase angle is below the first phase angle $\theta_1$, it begins adjusting the percentage duty cycle of the PWM power control signal downward from the highest power setting, in order to lower the output power of the power converter 220. The power converter 220 therefore determines and outputs power to the LED load 230 based on the magnitude of the rectified voltage Urect and the power setting of the PWM power control signal, e.g., modulated by the microcontroller 215. In other words, the power converter 220 runs in a closed loop using feedback from the PWM power control signal.

The PWM power control signal is adjusted downward in response to reductions in the detected dimmer phase angle until the detected dimmer phase angle reaches a predetermined second threshold, indicated by second phase angle $\theta_2$, discussed below. Note that the representative curve in FIG. 3 shows linear pulse width modulation from the highest power setting at the first phase angle $\theta_1$ to a lowest power setting at the second phase angle $\theta_2$, indicated by a linear ramp. However, a non-linear ramp may be incorporated, without departing from the scope of the present teachings. For example, in various embodiments, a non-linear function of the PWM power control signal may be necessary to create a linear feel of the light output by the LED load 230 corresponding to operation of the dimmer's slider, as would be apparent to one of ordinary skill in the art.

When the phase angle detection circuit 210 determines that the dimmer phase angle has been reduced to below the predetermined second threshold, indicated by the second phase angle $\theta_2$, the duty cycle of the PWM power control signal is set to its lowest power setting (e.g., zero percent duty cycle), which fixes the operating point of the power converter 220. The power converter 220 therefore determines and outputs power to the LED load 230 based only on the magnitude of the rectified voltage Urect. In other words, the power converter 220 again runs in an open loop, such that only the phase chopping dimmer modulates the power delivered to the output of the power converter 220, via the rectification circuit 205.

The value of the second phase angle $\theta_2$ may vary to provide unique benefits for any particular situation or to meet application specific design requirements of various implementations, as would be apparent to one of ordinary skill in the art. For example, the value of the second phase angle $\theta_2$ may be the dimmer phase angle at which further reduction in power to the LED load 230 would cause the load to drop below the minimum load requirements of the power converter 220. Alternatively, the value of the second phase angle $\theta_2$ may be the dimmer phase angle corresponding to a predetermined minimum level of light output by the LED load 230. In various alternative embodiments, the second phase angle $\theta_2$ may simply be zero, in which case the power converter 220 runs in the closed loop mode, using feedback from the PWM power control signal, until the dimmer phase angle is decreased to its minimum level (which may be zero or some predetermined minimum level above zero).

Figure 4:
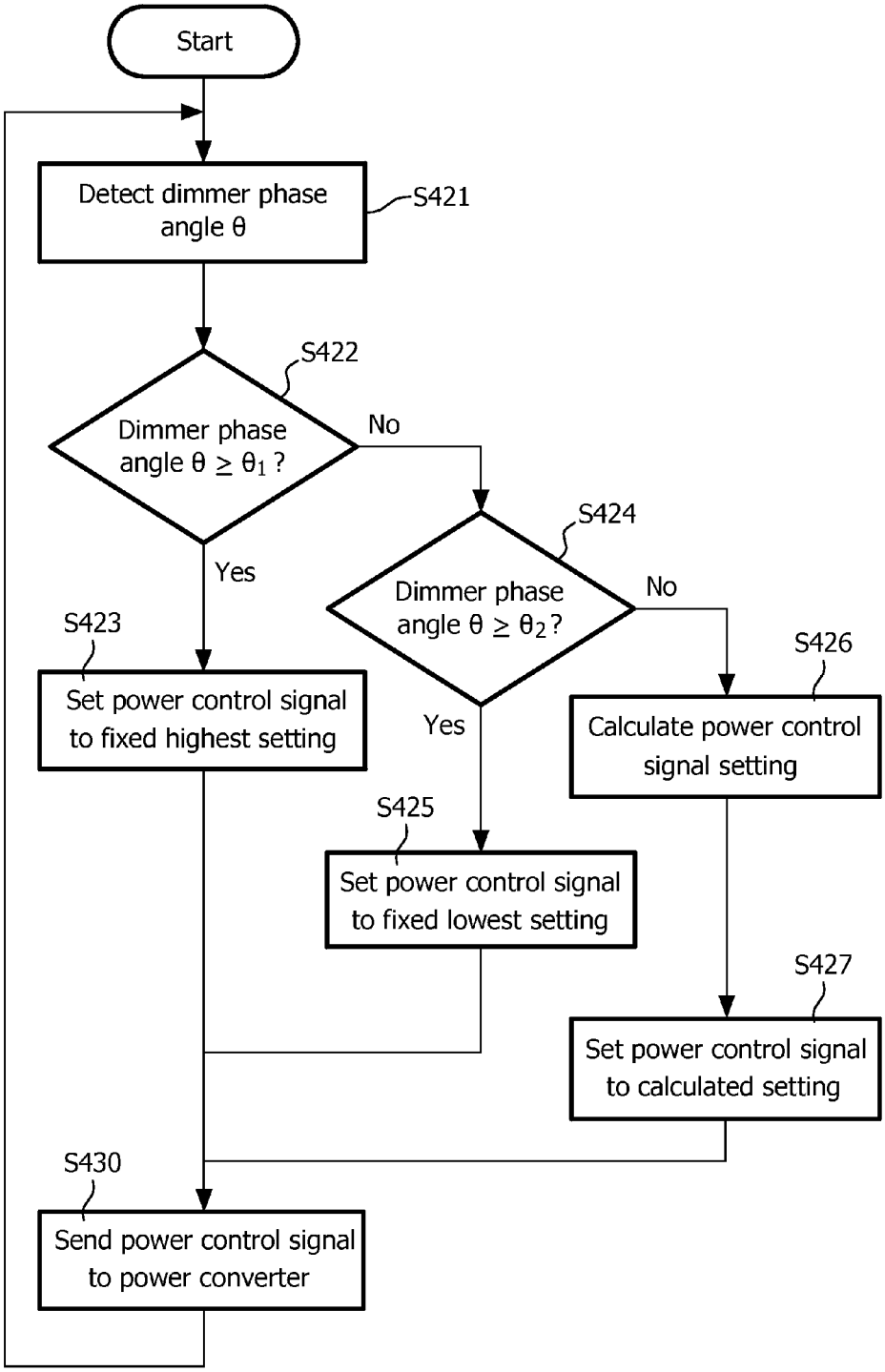
FIG. 4 is a flow diagram showing a process of setting a power control signal for controlling output power of a power converter, according to a representative embodiment.

FIG. 4 is a flow diagram showing a process of setting a power control signal for controlling output power of a power converter, according to a representative embodiment. The process shown in FIG. 4 may be implemented, for example, by the microcontroller 215 shown in FIG. 2, although other types of processors and controllers may be used without departing from the scope of the present teachings.

In block 5421, the dimmer phase angle $\theta$ is determined by the phase angle detection circuit 210. In block 5422, it is determined whether the detected dimmer phase angle is greater than or equal to the first phase angle $\theta_1$, which corresponds to the predetermined first threshold. When the detected dimmer phase angle is greater than or equal to the first phase angle $\theta_1$ (block 5422: Yes), the PWM power control signal is set to a fixed highest setting (e.g., 100 percent duty cycle) at block 5423. The PWM power control signal is sent to the power converter 220 via control line 229 in block 5430, and the process returns to block 5421 to continue detection of the dimmer phase angle $\theta$.

When the detected dimmer phase angle is not greater than or equal to the first phase angle $\theta_1$ (block 5422: No), it is determined in block 5424 whether the detected dimmer phase angle is less than or equal to the second phase angle $\theta_2$, which corresponds to the predetermined second threshold. When the detected dimmer phase angle is less than or equal to the second phase angle $\theta_1$ (block 5424: Yes), the PWM power control signal is set to a fixed lowest setting (e.g., zero percent duty cycle) at block 5425. The PWM power control signal is sent to the power converter 220 via control line 229 in block 5430, and the process returns to block 5421 to continue detection of the dimmer phase angle $\theta$.

When the detected dimmer phase angle is not less than or equal to the second phase angle $\theta_2$ (block 5424: No), the PWM power control signal is calculated in block 5426. For example, the percentage duty cycle of the PWM power control signal may be calculated in accordance with a predetermined function of the detected dimmer phase angle, e.g., implemented as a software and/or firmware algorithm executed by the microcontroller 215, in order to provide a corresponding power setting. The predetermined function may be a linear function which provides linearly decreasing percentage duty cycles corresponding to decreasing dimming levels. Alternatively, the predetermined function may be a non-linear function which provides non-linearly decreasing percentage duty cycles corresponding to decreasing dimming levels. The duty cycle of the PWM power control signal is set to the calculated percentage in block 5427 and sent to the power converter 220 via control line 229 in block 5430. The process returns to block 5421 to continue detection of the dimmer phase angle θ.

In the depicted embodiment, a separate determination is made in block 5424 regarding whether the detected dimmer phase angle is less than or equal to the second phase angle $\theta_2$ after the detected dimmer phase angle is determined to have dropped below the first phase angle $\theta_1$ in block 5422, before the PWM power control signal is calculated in block 5426 according to the predetermined function. However, in various alternative embodiments, an explicit comparison to the second phase angle $\theta_2$ may be excluded, such that the PWM power control signal is calculated in block 5426 (and the power converter beings operation in the closed loop mode), once it has been determined that the detected dimmer phase angle θ is less than the first phase angle $\theta_1$. For example, the predetermined function itself may result in the percentage duty cycle being set to the fixed lowest power setting at the second phase angle $\theta_2$, without having to make a separate comparison between the detected dimmer phase angle θ and the second phase angle $\theta_2$.

Figure 5:
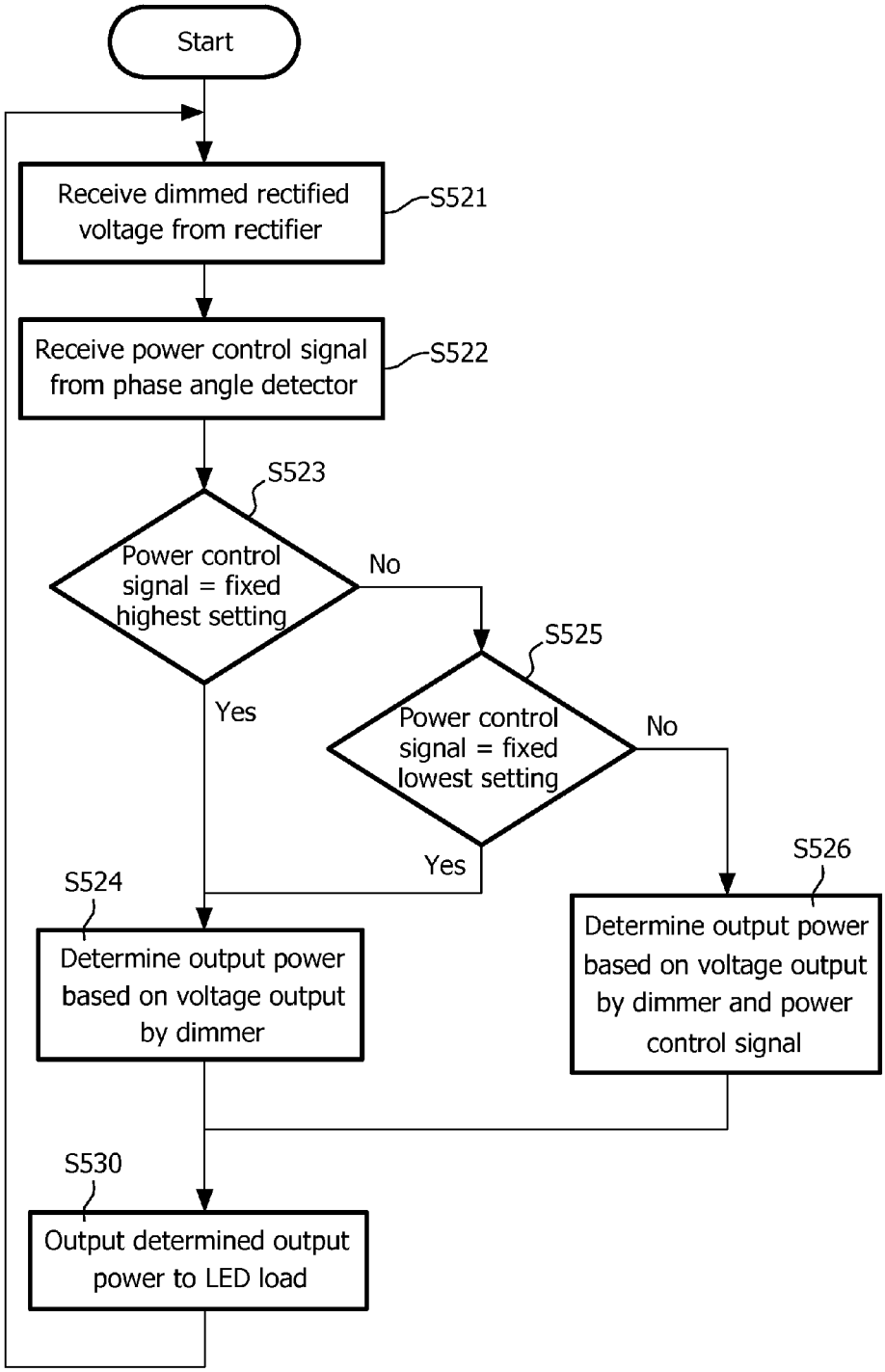
FIG. 5 is a flow diagram showing a process of providing output power of a power converter, according to a representative embodiment.

FIG. 5 is a flow diagram showing a process of determining output power of a power converter, according to a representative embodiment. The process shown in FIG. 4 may be implemented, for example, by the power converter 220 shown in FIG. 2, although other types of processors and controllers may be used without departing from the scope of the present teachings.

In block S521, the power converter 220 receives the (dimmed) rectified voltage Urect from the rectification circuit 205. At the same time, in block S522, the power converter 220 receives the PWM power control signal from the phase angle detector 210, as indicated in block 5430 of FIG. 4. It is determined in block S523 whether the PWM power control signal is at the fixed highest setting. When the PWM power control signal is at the fixed highest setting (block S523: Yes), the operating point of the power converter 220 is fixed and the output power is determined in an open loop mode in block S524, based only on the magnitude of the rectified voltage received in block S521. The determined output power is output to the LED load 230 in block S530 and the process returns to block S521.

When the PWM power control signal is not at the fixed highest setting (block S523: No), it is determined in block S525 whether the PWM power control signal is at the fixed lowest setting. When the PWM power control signal is at the fixed lowest setting (block S525: Yes), the operating point of the power converter 220 is fixed and the output power is determined in an open loop mode in block S524, based only on the magnitude of the rectified voltage received in block S521. The determined output power is output to the LED load 230 in block S530 and the process returns to block S521.

When the PWM power control signal is not at the fixed lowest setting (block S525: No), the output power is determined in a closed loop mode in block S526, based on the magnitude of the rectified voltage received in block S521 and the PWM power control signal received in block S522. The determined output power is output to the LED load 230 in block S530 and the process returns to block S521.

In the depicted embodiment, a separate determination is made in block S525 regarding whether the PWM power control signal is at the fixed lowest power setting after it is determined in block S523 that the PWM power control signal is not at the fixed highest power setting and before the output power is determined based on both the magnitude of the rectified voltage and the PWM power control signal in block S526. However, in various alternative embodiments, an explicit comparison to the fixed lowest power setting may be excluded, such that the output power signal is controlled based on both the magnitude of the rectified voltage and the PWM power control signal at any power setting (provided by the PWM power control signal) that is less than the fixed highest power setting. For example, the power converter 220 may be configured to output diminishing levels of output power corresponding to diminishing power settings, such that the lowest level of output power corresponds to the lowest power setting, without having to make a separate comparison between the power setting of the PWM power control signal and the predetermined fixed lowest power setting.

Referring again to FIG. 2, in the depicted representative embodiment, the phase angle detection circuit 210 includes the microcontroller 215, which uses waveforms of the rectified voltage Urect to determine the dimmer phase angle. The microcontroller 215 includes digital input pin 218 connected between a top diode D211 and a bottom diode D212. The top diode D211 has an anode connected to the digital input pin 218 and a cathode connected to voltage source Vcc, and the bottom diode 112 has an anode connected to ground and a cathode connected to the digital input pin 218. The microcontroller 215 also includes a digital output, such as PWM output 219.

In various embodiments, the microcontroller 215 may be a PIC12F683, available from Microchip Technology, Inc., for example, although other types of microcontrollers or other processors may be included without departing from the scope of the present teachings. For example, the functionality of the microcontroller 215 may be implemented by one or more processors and/or controllers, and corresponding memory, which may be programmed using software or firmware to perform the various functions, or may be implemented as a combination of dedicated hardware to perform some functions and a processor (e.g., one or more programmed microprocessors and associated circuitry) to perform other functions. Examples of controller components that may be employed in various embodiments include, but are not limited to, conventional microprocessors, microcontrollers, ASICs and FPGAs, as discussed above.

The phase angle detection circuit 210 further includes various passive electronic components, such as first and second capacitors C213 and C214, and first and second resistors R211 and R212. The first capacitor C213 is connected between the digital input pin 218 of the microcontroller 215 and a detection node N1. The second capacitor C214 is connected between the detection node N1 and ground. The first and second resistors R211 and R212 are connected in series between the rectified voltage node N2 and the detection node N1. In the depicted embodiment, the first capacitor C213 may have a value of about 560 pF and the second capacitor C214 may have a value of about 10 pF, for example. Also, the first resistor R211 may have a value of about 1 megohm and the second resistor R212 may have a value of about 1 megohm, for example. However, the respective values of the first and second capacitors C213 and C214, and the first and second resistors R211 and R212 may vary to provide unique benefits for any particular situation or to meet application specific design requirements of various implementations, as would be apparent to one of ordinary skill in the art.

The (dimmed) rectified voltage Urect is AC coupled to the digital input pin 218 of the microcontroller 215. The first resistor R211 and the second resistor R212 limit the current into the digital input pin 218. When a signal waveform of the rectified voltage Urect goes high, the first capacitor C213 is charged on the rising edge through the first and second resistors R211 and R212. The top diode D211 inside the microcontroller 215 clamps the digital input pin 218 one diode drop above Vcc, for example. On the falling edge of the signal waveform of the rectified voltage Urect, the first capacitor C213 discharges and the digital input pin 218 is clamped to one diode drop below ground by the bottom diode D212. Accordingly, the resulting logic level digital pulse at the digital input pin 218 of the microcontroller 215 closely follows the movement of the chopped rectified voltage Urect, examples of which are shown in FIGS. 6A-6C.

Figure 6A:
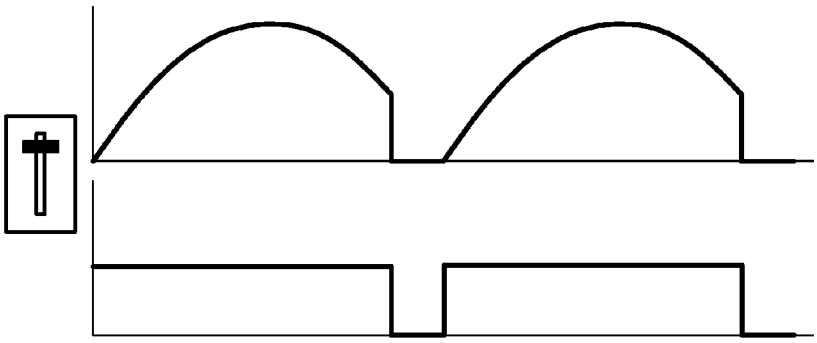
FIGS. 6A-6C show sample waveforms and corresponding digital pulses of a dimmer, according to a representative embodiment.
Figure 6B:
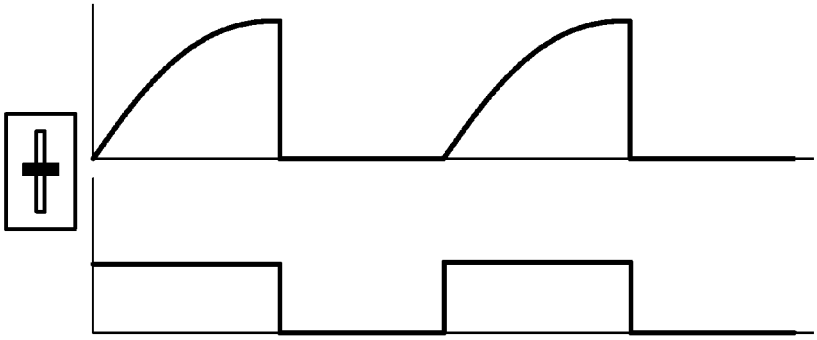
Figure 6C:
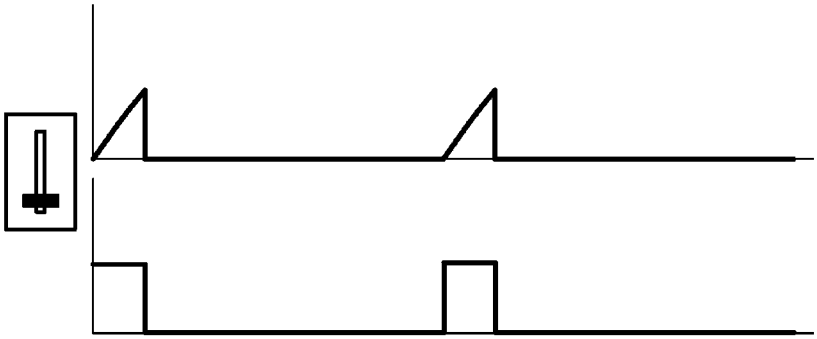

More particularly, FIGS. 6A-6C show sample waveforms and corresponding digital pulses at the digital input pin 218, according to representative embodiments. The top waveforms in each figure depict the chopped rectified voltage Urect, where the amount of chopping reflects the level of dimming. For example, the waveforms may depict a portion of a full 170V (or 340V for E.U.) peak, rectified sine wave that appears at the output of the dimmer. The bottom square waveforms depict the corresponding digital pulses seen at the digital input pin 218 of the microcontroller 215. Notably, the length of each digital pulse corresponds to a chopped waveform, and thus is equal to the amount of time the dimmer's internal switch is "on." By receiving the digital pulses via the digital input pin 218, the microcontroller 215 is able to determine the level to which the dimmer has been set.

FIG. 6A shows sample waveforms of rectified voltage Urect and corresponding digital pulses when the dimmer is at its highest setting, indicated by the top position of the dimmer slider shown next to the waveforms. FIG. 6B shows sample waveforms of rectified voltage Urect and corresponding digital pulses when the dimmer is at a medium setting, indicated by the middle position of the dimmer slider shown next to the waveforms. FIG. 6C shows sample waveforms of rectified voltage Urect and corresponding digital pulses when the dimmer is at its lowest setting, indicated by the bottom position of the dimmer slider shown next to the waveforms.

Figure 7:
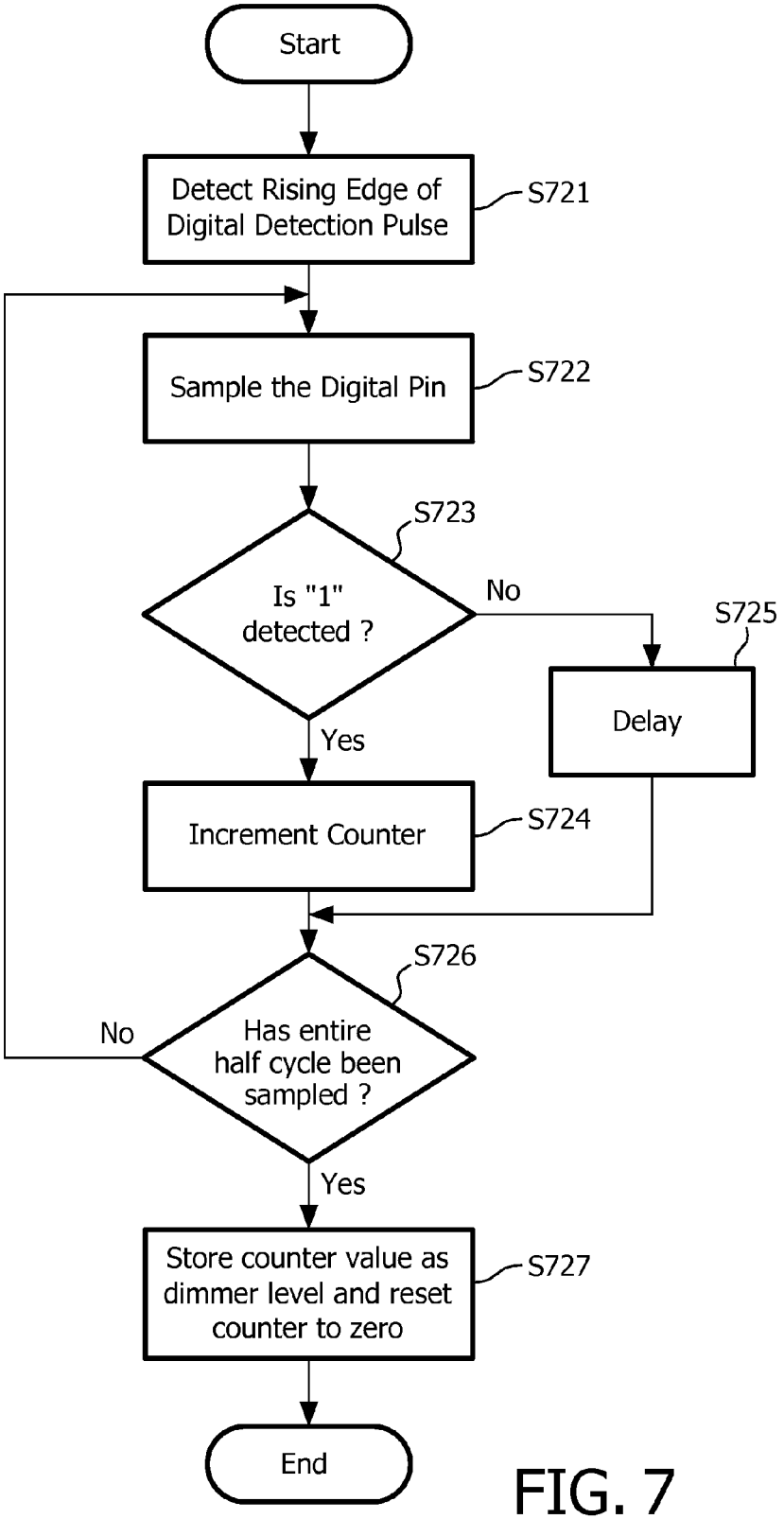
FIG. 7 is a flow diagram showing a process of detecting the phase angle of a dimmer, according to a representative embodiment.

FIG. 7 is a flow diagram showing a process of detecting the dimmer phase angle of a dimmer, according to a representative embodiment. The process may be implemented by firmware and/or software executed by the microcontroller 215 shown in FIG. 2, for example, or more generally by the phase angle detector 110 shown in FIG. 1.

In block S721 of FIG. 7, a rising edge of a digital pulse of an input signal (e.g., indicated by rising edges of the bottom waveforms in FIGS. 6A-6C) is detected, and sampling at the digital input pin 218 of the microcontroller 215, for example, begins in block S722. In the depicted embodiment, the signal is sampled digitally for a predetermined time equal to just under a mains half cycle. Each time the signal is sampled, it is determined in block S723 whether the sample has a high level (e.g., digital "1") or a low level (e.g., digital "0"). In the depicted embodiment, a comparison is made in block S723 to determine whether the sample is digital "1." When the sample is digital "1" (block S723: Yes), a counter is incremented in block S724, and when the sample is not digital "1" (block S723: No), a small delay is inserted in block S725. The delay is inserted so that the number of clock cycles (e.g., of the microcontroller 215) is equal regardless of whether the sample is determined to be digital "1" or digital "0."

In block S726, it is determined whether the entire mains half cycle has been sampled. When the mains half cycle is not complete (block S726: No), the process returns to block S722 to again sample the signal at the digital input pin 218. When the mains half cycle is complete (block S726: Yes), the sampling stops and the counter value (accumulated in block S724) is identified as the current dimmer phase angle or dimming level in block S727, which is stored, e.g., in a memory, examples of which are discussed above. The counter is reset to zero, and the microcontroller 215 waits for the next rising edge to begin sampling again.

For example, it may be assumed that the microcontroller 215 takes 255 samples during a mains half cycle. When the dimming level is set by the slider at the top of its range (e.g., as shown in FIG. 6A), the counter will increment to about 255 in block S724 of FIG. 6. When the dimming level is set by the slider at the bottom of its range (e.g., as shown in FIG. 6C), the counter will increment to only about 10 or 20 in block S724. When the dimming level is set somewhere in the middle of its range (e.g., as shown in FIG. 6B), the counter will increment to about 128 in block S724. The value of the counter thus gives the microcontroller 215 an accurate indication of the level to which the dimmer has been set or the phase angle of the dimmer. In various embodiments, the dimmer phase angle may be calculated, e.g., by the microcontroller 215, using a predetermined function of the counter value, where the function may vary in order to provide unique benefits for any particular situation or to meet application specific design requirements of various implementations, as would be apparent to one of ordinary skill in the art.

Accordingly, the phase angle of the dimmer may be electronically detected, using minimal passive components and a digital input structure of a microcontroller (or other processor or processing circuit). In an embodiment, the phase angle detection is accomplished using an AC coupling circuit, a microcontroller diode clamped digital input structure and an algorithm (e.g., implemented by firmware, software and/or hardware) executed to determine the dimmer setting level. Additionally, the condition of the dimmer may be measured with minimal component count and taking advantage of the digital input structure of a microcontroller.

In addition, the dimming control system, including the dimmer phase angle detection circuit and the power controller, and the associated algorithm(s) may be used in various situations where it is desired to control dimming at low dimmer phase angles of a phase chopping dimmer, at which dimming would otherwise stop in conventional systems. The dimming control system increases dimming range, and can be used with an electronic transformer with an LED load that is connected to a phase chopping dimmer, especially in situations where the low end dimming level is required to be within a range less than about five percent of the maximum light output, for example.

The dimming control system, according to various embodiments, may be implemented in various white light luminaries. Further, it may be used as a building block of "smart" improvements to various products to make them more dimmer friendly.

In various embodiments, the functionality of the dimmer phase angle detector 110, the phase angle detection circuit 210 or the microprocessor 215 may be implemented by one or more processing circuits, constructed of any combination of hardware, firmware or software architectures, and may include its own memory (e.g., nonvolatile memory) for storing executable software/firmware executable code that allows it to perform the various functions. For example, the respective functionality may be implemented using ASICs, FPGAs and the like.

Those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one." As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited. Further, reference numerals, if any, are provided in the claims merely for convenience and should not be construed as limiting in any way.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively,

The invention claimed is:

1. A system for controlling a level of light output by a solid state lighting load controlled by a dimmer, the system comprising:

a phase angle detector configured to detect a phase angle of the dimmer based on a rectified voltage from the dimmer and to determine a power control signal based on the detected phase angle and comparison of the detected phase angle with a predetermined first threshold; and a power converter configured to provide an output voltage to the solid state lighting load, the power converter providing the output voltage in response to the rectified voltage from the dimmer in an open loop mode when the detected phase angle is greater than the predetermined first threshold, and providing the output voltage in response to the rectified voltage from the dimmer and the variable power control signal determined by the phase angle detector in a closed loop mode when the detected phase angle is less than the predetermined first threshold.

2. The system of claim 1, wherein the phase angle detector determines the power control signal to be a predetermined first fixed value when the detected phase angle is greater than the predetermined first threshold.

3. The system of claim 2, wherein the phase angle detector determines the power control signal to be a variable calculated as a function of the detected phase angle when the detected phase angle is less than the predetermined first threshold.

4. The system of claim 3, wherein the power control signal comprises a duty cycle adjustable by the phase angle detector.

5. The system of claim 4, wherein the duty cycle has a maximum value corresponding to the predetermined first fixed value of the power control signal when the detected phase angle is greater than the predetermined first threshold.

6. The system of claim 5, wherein the duty cycle has a duty cycle percentage of 100 percent.

7. The system of claim 4, wherein the duty cycle has a variable value corresponding to the predetermined first fixed value of the power control signal when the detected phase angle is less than the predetermied first threshold.

8. The system of claim 7, wherein the duty cycle has a duty cycle percentage that decreases in proportion to decreases in the detected phase angle.

9. The system of claim 4, wherein the power control signal comprises a pulse width modulation (PWM) signal.

10. The system of claim 3, wherein the phase angle detector is further configured to determine the power control signal based on comparison of the detected phase angle with a predetermined second threshold, lower than the predetermined first threshold; and wherein the power converter operates in the open loop mode based on the rectified voltage from the dimmer when the detected phase angle is less than the second threshold.

11. The system of claim 10, wherein the phase angle detector determines the power control signal to be a predetermined second fixed value when the detected phase angle is less than the second threshold value.

12. The system of claim 11, wherein the power control signal comprises a duty cycle adjustable by the phase angle detector, the duty cycle having a minimum value corresponding to the predetermined second fixed value of the power control signal when the detected phase angle is less than the second threshold value.

13. The system of claim 12, wherein the duty cycle has a duty cycle percentage of zero percent.

14. A power throttling method for controlling a level of light output by a solid state lighting (SSL) load through a power controller connected to a dimmer, the method comprising:

detecting a phase angle of the dimmer corresponding to a dimming level set at the dimmer;

when the detected phase angle is greater than a first dimming threshold, generating a power control signal having a first fixed power setting and modulating a light output level of the SSL load based on a magnitude of voltage output by the dimmer; and when the detected phase angle is less than the first dimming threshold, generating the power control signal having a power setting determined as a function of the detected phase angle, and modulating the light output level of the SSL load based on the magnitude of voltage output by the dimmer and the determined power setting.

15. The method of claim 14, further comprising:

when the detected phase angle is less than a second dimming threshold, generating the power control signal having a second fixed power setting and modulating the light output level of the SSL load based on the magnitude of voltage output by the dimmer, wherein the second dimming threshold is less than the first dimming threshold and the second fixed power setting is less than the first fixed power setting.

16. The method of claim 14, wherein the function of the detected phase angle comprises a linear function.

17. The method of claim 14, wherein the function of the detected phase angle comprises a non-linear function.

18. A device comprising:

a light emitting diode (LED) load having a light output responsive to a phase angle of a dimmer;

a phase angle detection circuit configured to detect the dimmer phase angle and to output a pulse width modulation (PWM) power control signal from a PWM output, the PWM power control signal having a duty cycle determined based on the detected dimmer phase angle; and a power converter configured to receive a rectified voltage from the dimmer and the PWM power control signal from the phase angle detection circuit, and to provide an output voltage to the LED load;

wherein the phase angle detection circuit sets the duty cycle of the PWM power control signal to a fixed high percentage when the detected phase angle exceeds a high threshold, causing the power converter to determine the output voltage based on a magnitude of the rectified voltage, and wherein the phase angle detection circuit sets the duty cycle of the PWM power control signal to a variable percentage, calculated as a predetermined function of the detected phase angle, when the detected phase angle is less than the high threshold, causing the power converter to determine the output voltage based on the PWM power control signal in addition to the magnitude of the rectified voltage.

19. The device of claim 18, wherein the phase angle detection circuit comprises:

a microcontroller comprising a digital input and at least one diode clamping the digital input to a voltage source;

a first capacitor connected between the digital input of the microcontroller and a detection node;

a second capacitor connected between the detection node and ground; and at least one resistor connected between the detection node and a rectified voltage node receiving a rectified voltage from the dimmer.

20. The device of claim 19, wherein the microcontroller executes an algorithm comprising sampling digital pulses received at the digital input corresponding to waveforms of the rectified voltage at the rectified voltage node, and determining lengths of the sampled digital pulses to identify the dimming level of the dimmer.

* * * * *